US006463918B1

(12) United States Patent
Moga et al.

(10) Patent No.: US 6,463,918 B1
(45) Date of Patent: Oct. 15, 2002

(54) IGNITION APPARATUS HAVING AN ELECTRICALLY FLOATING SHIELD

(75) Inventors: Viorel N. Moga; Albert Anthony Skinner, both of Anderson, IN (US); Steve T Kowalke, Evanston, IL (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/783,635

(22) Filed: Feb. 14, 2001

(51) Int. Cl.[7] ..... F02P 11/00
(52) U.S. Cl. ..... 123/633; 315/85; 123/634
(58) Field of Search ..... 123/634, 633; 315/85

(56) References Cited

U.S. PATENT DOCUMENTS 4,159,441 A 6/1979 Livingston ..... 315/85
5,699,230 A 12/1997 Ota ..... 361/736
5,706,792 A 1/1998 Boyer et al. ..... 123/634
6,213,109 B1 * 4/2001 Satoo et al. ..... 123/634
6,237,578 B1 * 5/2001 Satoo et al. ..... 123/634

FOREIGN PATENT DOCUMENTS

JP 403149805 A * 6/1991
JP 07045129 A * 2/1995
JP 409232161 A * 9/1997

* cited by examiner

*Primary Examiner*—Erick Solis
(74) *Attorney, Agent, or Firm*—Margaret A. Dobrowitsky

(57) ABSTRACT

An ignition apparatus includes a magnetic circuit comprising a central core and a side core or shield, and primary and secondary windings. The shield is allowed to electrically float, thereby reducing the capacitance of the secondary winding. A housing is external to and surrounds the shield to inhibit arcing. A silicone boot overlaps a housing/case interface to further suppress arcing.

18 Claims, 2 Drawing Sheets

IGNITION APPARATUS HAVING AN ELECTRICALLY FLOATING SHIELD

BACKGROUND OF THE INVENTION

1. Technical Field

The present invention relates generally to an ignition apparatus, and, more particularly, an ignition apparatus having an electrically floating shield.

2. Discussion of the Background Art

Ignition apparatuses utilize primary and secondary windings and a magnetic circuit. The magnetic circuit may include a central core formed of steel laminations or compression molded insulated iron particles, and a side core or shield, tubular in shape, formed of silicon steel, as seen by reference to U.S. Pat. No. 5,706,792 issued to Boyer et al. Boyer et al. further disclose an ignition apparatus having a relatively slender configuration adapted for mounting directly above a spark plug in a spark plug well—commonly referred to as a "pencil" coil. Boyer et al. further disclose that the shield is electrically grounded, ostensibly to inhibit a voltage rise from occurring at the shield. Boyer et al. further disclose that the shield is the radially outermost portion of the ignition coil (i.e., it has no electrical insulation outwardly thereof).

The ignition apparatus of Boyer et al. is of the type having a secondary winding that is outwardly of the primary winding. This type yields a relatively high electric field between the secondary winding and the shield. This electric field, among other things, results in a relatively high capacitance with respect to the secondary winding. The secondary winding voltage that can be obtained during operation is determined in terms of energy and capacitance, as follows:

$$V=\sqrt{2*E/C}$$

In order to obtain a short charge time and a low energy per pulse, for example as may be desirable in a multicharge/multistrike system, the low energy may not be able to charge the secondary winding capacitance to an acceptable value. This situation is generally undesirable.

There is therefore a need for an ignition apparatus that minimizes or eliminates one or more of the problems as set forth above.

SUMMARY OF THE INVENTION

An object of the present invention is to solve one or more of the problems set forth in the Background. One advantage of the present invention is that it provides an ignition apparatus having a secondary capacitance that is reduced relative to conventional ignition apparatuses, which allows a relatively short charge time. In addition, the reduced capacitance results in a reduced electric field between the secondary winding and the shield assembly (i.e., a reduced electric field through the case), thereby increasing durability of the ignition apparatus (i.e., a high electric field tends to break down common case materials due to corona discharge erosion).

An ignition apparatus according to the invention comprises a core having a main axis, a primary and secondary winding radially outwardly of the core, a first end of the primary winding being configured to be coupled to a power source and a second end coupled to ground, a conductive shield radially outwardly of the windings that is floating relative to ground, and a housing of electrically insulative material radially outwardly of the shield. Since the shield is allowed to float, the capacitance between the secondary winding and the shield drops by about four times. This reduces the overall capacitance seen by the secondary winding by between about 20% to 30% relative to conventional configurations where the shield is grounded. The shield, being ungrounded, however, rises to a voltage of about ½ the secondary voltage. During discharge (i.e., spark event) this level may be relatively high. The insulative housing inhibits arcing between the shield and a local ground (e.g., part of the spark plug well).

As an optional feature, the ignition apparatus further includes a boot, made of electrical insulative material, overlapping an interface where an axial end of the case engages the housing.

BRIEF DESCRIPTION OF THE DRAWINGS

The present invention will now be described by way of example, with reference to the accompanying drawings, in which.

DETAILED DESCRIPTION OF THE PREFERRED EMBODIMENTS

Figure 1:
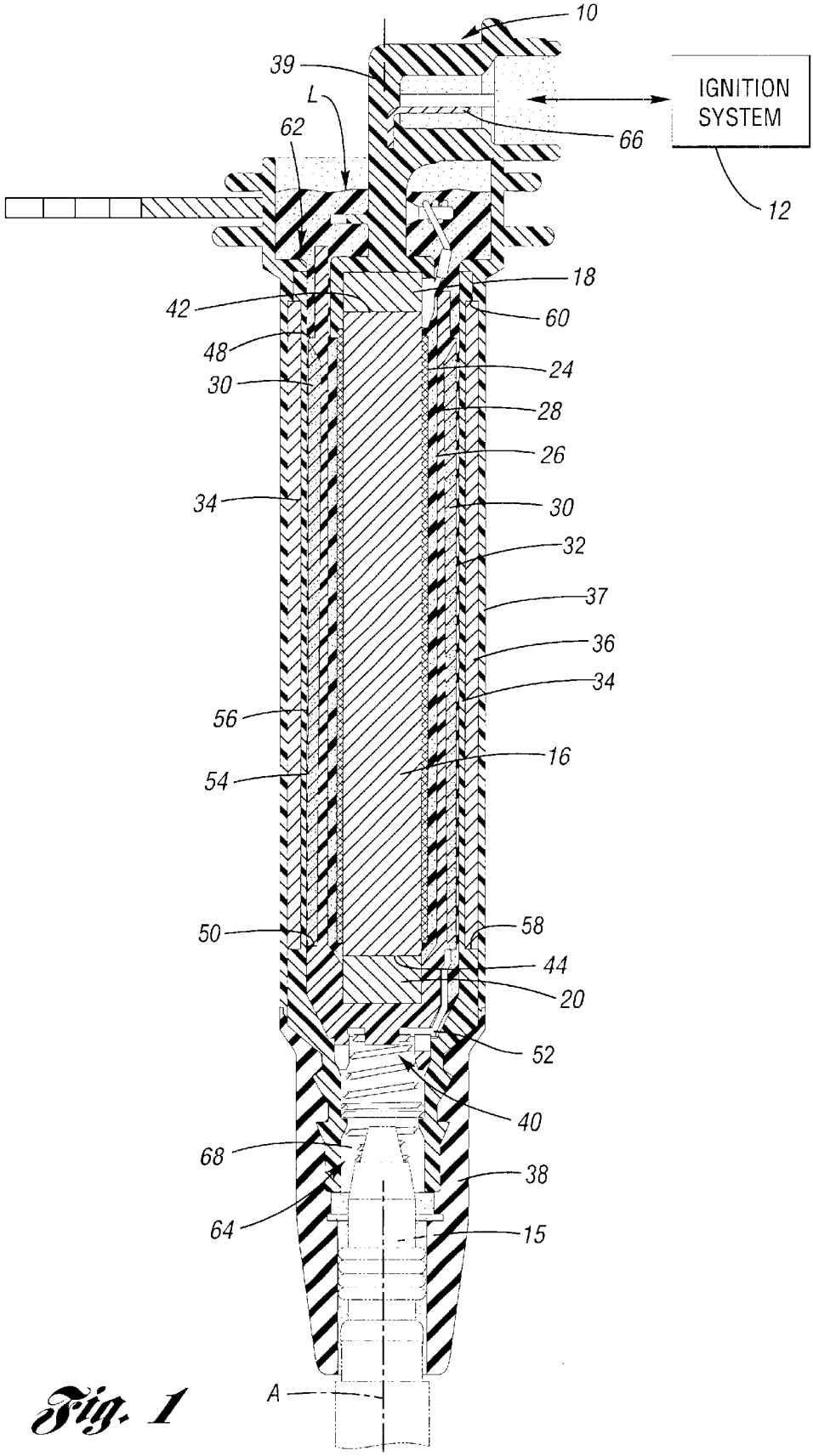
FIG. 1 is a simplified sectional view showing an ignition apparatus in accordance with the present invention.

Referring now to the drawings wherein like reference numerals are used to identify identical components in the various views, FIG. 1 is an simplified sectional view of an ignition apparatus 10 in accordance with the invention, having an electrically floating side core or shield assembly. As is generally known, ignition apparatus 10 may be coupled to, for example, an ignition system 12, which contains primary energization circuitry for controlling the charging and discharging of ignition apparatus 10. Further, also as is well known, the relatively high voltage produced by ignition apparatus 10 is provided to spark plug 14 (shown in phantom-line format) for producing a spark across a spark gap thereof, which may be employed to initiate combustion in a combustion chamber of an engine. Ignition system 12 and spark plug 14 perform conventional functions well known to those of ordinary skill in the art.

Ignition apparatus 10 is adapted for installation to a conventional internal combustion engine onto a high-voltage terminal of spark plug 14, which may be retained by a threaded engagement with a spark plug opening of an engine head.

Ignition apparatus 10 comprises in-effect a substantially slender high voltage transformer including substantially, coaxially arranged primary and secondary windings and a high permeability magnetic central core.

FIG. 1 further illustrates a central core 16, an optional first magnet 18, an optional second magnet 20, a primary winding 24, a first epoxy potting material layer 26, a secondary winding spool 28, a secondary winding 30, a second epoxy potting material layer 32, a case 34, a shield assembly 36, a housing assembly 37, a boot assembly 38, a low-voltage (LV) connector body 39, and a high-voltage (HV) connector assembly 40.

Figure 2:
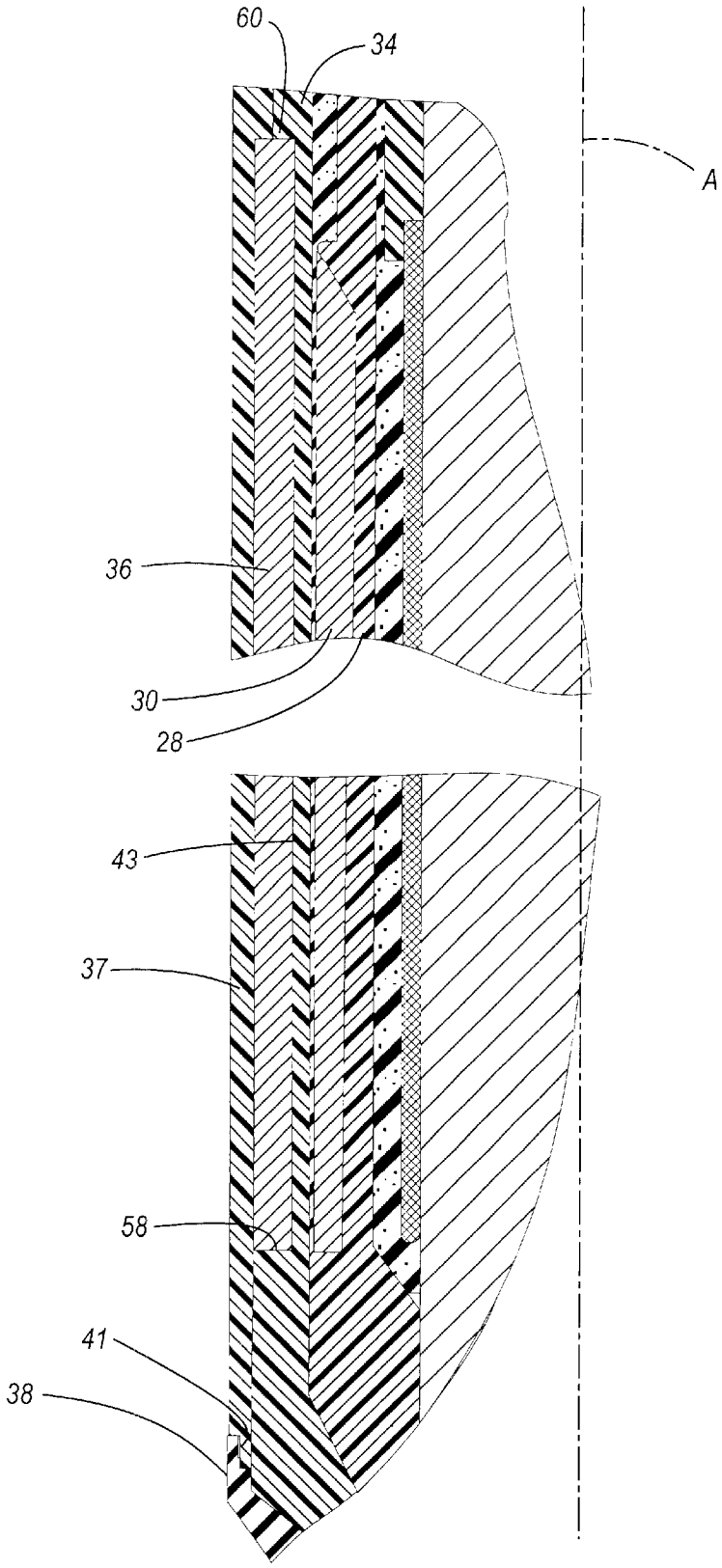
FIG. 2 is an enlarged sectional view showing an exemplary construction of a portion of the ignition apparatus shown in FIG. 1.

FIG. 2 illustrates in greater detail a portion of ignition apparatus 10 relating more particularly to the present invention. As described in the Background, the secondary voltage output of apparatus 10 is a function of the capacitance of the secondary winding according to a formula: $V=\sqrt{2*E/C}$.

According to the present invention, the capacitance of the secondary winding is decreased by not grounding shield assembly 36, but rather by allowing shield assembly 36 to electrically "float" relative to ground. The shield assembly 36, during the discharge of ignition apparatus 10 (i.e., via interruption of primary current, as known in the art), floats to about ½ the secondary voltage. The capacitance between the secondary winding 30 and shield assembly 36 drops by about four times, in accordance with the equation referred to above. A challenge, however, in allowing shield assembly 36 to float is that since it is at a relatively high voltage (e.g., ½ the secondary output voltage), there is a chance that the shield assembly 36 may arc to a nearby ground (e.g., spark plug well or other metal component of the engine in the vicinity).

According to the invention, an electrically-insulative housing 37 is disposed outwardly of shield assembly 36 to surround shield assembly 36, thereby inhibiting an electric arc from occurring. To further reduce the chance of an arc occurring, boot assembly 38 is axially extended to overlap an interface where case 34 engages housing 37.

In a preferred embodiment, the housing assembly 37 has a longitudinal extent greater than that of shield assembly 36, to inhibit arcing through an interface boundary or region 41. Also as shown, case 34 includes an annular groove 43 configured to receive shield assembly 36. The groove 43 comprises first and second shoulders 58, and 60. Housing 37, in the illustrated embodiment, overlaps shoulders 58, 60, again to reduce the chance of arcing.

Referring again to FIG. 1, greater detail regarding the illustrated embodiment will now be set forth. Central core 16 may be elongated, having a main, longitudinal axis "A" associated therewith. Core 16 includes an upper, first end 42, and a lower, second end 44. For example, core 16 may be a conventional core known to those of ordinary skill in the art. Core 16 comprises magnetically permeable material, for example, a plurality of silicon steel laminations, or, insulated iron particles compression molded to a desired shape, as known. As illustrated, core 16, in a preferred embodiment, takes a generally cylindrical shape (which is a generally circular shape in radial cross-section).

Optional magnets 18 and 20 may be included in ignition apparatus 10 as part of the magnetic circuit, and provide a magnetic bias for improved performance. The construction of magnets such as magnets 18 and 20, as well as their use and effect on performance, is well understood by those of ordinary skill in the art. It should be understood that magnets 18 and 20 are optional in ignition apparatus 10, and may be omitted, albeit with a reduced level of performance, which may be acceptable, depending on performance requirements.

Primary winding 24 may conventionally be wound directly onto central core 16 (e.g., when central core 16 is compression molded insulated iron particles), or may be wound on a primary winding spool (not shown) when core 16 comprises steel laminations. Primary winding 24 includes first and second ends and is configured to carry a primary current $I_P$ for charging coil 10 upon control of ignition system 12. Winding 24 may be implemented using known approaches and conventional materials.

Layers 26 and 32 comprise epoxy potting material. The potting material may be introduced into potting channels defined (i) between primary winding 24 and secondary winding spool 28, and, (ii) between secondary winding 30 and case 34. The potting channels are filled with potting material, in the illustrated embodiment, up to approximately the level designated "L". The potting material performs the function of electrical insulation and, provides protection from environmental factors which may be encountered during the service life of ignition apparatus 10. There are a number of suitable epoxy potting materials well known to those of ordinary skill in the art.

Secondary winding spool 28 is configured to receive and retain secondary winding 30. Spool 28 is disposed adjacent to and radially outwardly of the central components comprising core 16, primary winding 24, and epoxy potting layer 26, and, preferably, is in coaxial relationship therewith. Spool 28 may comprise any one of a number of conventional spool configurations known to those of ordinary skill in the art. In the illustrated embodiment, spool 28 is configured to receive one continuous secondary winding (e.g., progressive winding), as is known. However, it should be understood that other configurations may be employed, such as, for example only, a configuration adapted for use with a segmented winding strategy (e.g., a spool of the type having a plurality of axially spaced ribs forming a plurality of channels therebetween for accepting windings).

The depth of the secondary winding in the illustrated embodiment decreases from the top of spool 28 (i.e., near the upper end 42 of core 16), to the other end of spool 28 (i.e., near the lower end 44) by way of a progressive gradual flare of the spool body. The result of the flare or taper is to increase the radial distance (i.e., taken with respect to axis "A") between primary winding 24 and secondary winding 30, progressively, from the top to the bottom. As is known in the art, the voltage gradient in the axial direction, which increases toward the spark plug end (i.e., high voltage end) of the secondary winding, may require increased dielectric insulation between the secondary and primary windings, and, may be provided for by way of the progressively increased separation between the secondary and primary windings.

Spool 28 is formed generally of electrical insulating material having properties suitable for use in a relatively high temperature environment. For example, spool 28 may comprise plastic material such as polybutylene terephthalate (PBT) thermoplastic polyester. It should be understood that there are a variety of alternative materials which may be used for spool 28 known to those of ordinary skill in the ignition art, the foregoing being exemplary only and not limiting in nature.

Spool 28 may further include a first annular feature 48 and a second annular feature 50 formed at axially opposite ends thereof. Features 48, and 50 may be configured so as to engage an inner surface of case 34 to locate, align, and center the spool 28 in the cavity of case 34.

In addition, the body portion of spool 28 tapers on a lower end thereof to a reduced diameter, generally cylindrical outer surface sized to provide an interference fit with respect to a corresponding through-aperture at the lower end of case 34. In addition, the spool body includes a blind bore or well at the spark plug end configured in size and shape to accommodate the size and shape of HV connector assembly 40. In connection with this function, spool 28 may be formed having an electrically conductive (i.e., metal) high-voltage (HV) terminal 52 disposed therein configured to connect a high voltage lead of secondary winding 30 to the HV connector assembly 40.

Secondary winding 30, as described above, is wound on spool 28, and includes a low voltage end and a high voltage end. The low voltage end may be connected to ground by way of a ground connection through LV connector body 39 in a manner known to those of ordinary skill in the art. The high voltage end is connected to the above-described (HV) terminal 52 for electrically connecting the high voltage generated by secondary winding 30 to HV connector assembly 40 for firing spark plug 14. As known, an interruption of a primary current $I_P$ through primary winding 24, as controlled by ignition system 12, is operative to produce a high voltage at the high voltage end of secondary winding 30. Winding 30 may be implemented using conventional approaches and material known to those of ordinary skill in the art.

Case 34 may include an inner, generally cylindrical surface 54, an outer surface 56, a first annular shoulder or flange 58, a flange 60, an upper through-bore 62, and a lower through bore 64.

Inner surface 54 is configured in size to receive and retain the core 16/primary winding 24/spool 28/secondary winding 30 assembly. The inner surface 54 of case 34 may be slightly spaced from spool 28, particularly the annular spacing features 48, 50 thereof (as shown), or may engage the spacing features 48, 50.

Annular shoulder or flange 58, and flange 60 are located near the lower, and upper ends of case 34, respectively.

Bore 62 is configured in size and shape to receive the combined assembly of core 16/primary winding 24/spool 28/secondary winding 30. Case 34 is formed of electrical insulating material, and may comprise conventional materials known to those of ordinary skill in the art (e.g., the PBT thermoplastic polyester material referred to above).

Shield assembly 36 is generally annular in shape and is disposed radially outwardly of case 34, and, preferably, engages an outer surface 56 of case 34. Shield 36 preferably comprises electrically conductive material, and more preferably, metal, such as silicon steel or other adequate magnetic material. Preferably the shield assembly 36 may include one or more cylindrical layers of silicon steel totaling a desired thickness. In one embodiment, the thickness may be between about 0.40 mm and 1.40 mm. Shield assembly 36, among other things, provides a magnetic path for the magnetic circuit portion of apparatus 10. As described above, shield assembly 36, although electrically conductive, is not grounded but rather is allowed to electrically float.

Housing assembly 37 may be formed of the same or similar material as case 34 (e.g., PBT in one embodiment). The thickness of housing 37 is generally selected to provide adequate electrical insulation and adequate during both criteria of which depend, in part, on the material chosen. In one exemplary embodiment, when PBT is used, the housing assembly thickness may range between about 0.50–1.50 mm.

Boot assembly 38 may comprise silicone material or other compliant, electrically insulative material, as known in the art. As shown, boot assembly 38 may be configured to slightly overlap a lower annular shoulder of housing assembly 37.

Low voltage connector body 39 is configured to, among other things, electrically connect the first and second ends of primary winding 24 to an energization source, such as the energization circuitry included in ignition system 12. Connector body 39 is generally formed of electrical insulating material, but also includes a plurality of electrically conductive terminals 66 (e.g., pins for ground, primary winding leads, etc.). Terminals 66 are coupled electrically, internally through connector body 39, in a manner known to those of ordinary skill in the art, and are thereafter connected to various parts of apparatus 10, also in a manner generally know to those of ordinary skill in the art. Ignition system 12 may then control energization of primary winding 24.

HV connector assembly 40 may include a spring contact 68 or the like, which is electrically coupled to HV terminal 52 (which is in turn coupled to the high voltage lead of secondary winding 30) disposed in a blind bore portion formed in a lowermost end of spool 28. Contact spring 68 is configured to engage a high-voltage connector terminal of spark plug 14. This arrangement for coupling the high voltage developed by secondary winding 30 to plug 14 is exemplary only; a number of alternative connector arrangements, particularly spring-biased arrangements, are known in the art.

An ignition apparatus according to the present invention allows the shield to electrically float, thereby reducing the capacitance of the secondary winding. This permits a relatively short charge time, low energy pulse to be generated by the ignition apparatus. In addition, the electric field that is produced in the area or region between the shield and the secondary winding (i.e., through the case) is reduced. This increases the durability of the apparatus (i.e., punch through the case due to corona erosion of case material is reduced). Also, no connection of the shield to a ground terminal is required, reducing complexity and cost. In addition, shield coating requirements are reduced. Moreover, lowering the electric field across the case to allows the use of thinner case walls, which savings in thickness may be allocated to the thickness of the housing (i.e., no significant, if any, increase in overall radial size of the apparatus).

It is to be understood that the above description is merely exemplary rather than limiting in nature, the invention being limited only by the appended claims. Various modifications and changes may be made thereto by one of ordinary skill in the art which embody the principles of the invention and fall within the spirit and scope thereof.

What is claimed is:

1. An ignition apparatus comprising:

a cylindrical central core having a main axis;

a primary and secondary winding radially outwardly of said central core, a first end of said primary winding being configured to be coupled to a power source and a second end of said primary winding being configured to be selectively coupled to ground;

an annular magnetically-permeable conductive shield defining a side core radially outwardly of said windings that is floating relative to ground configured to provide a magnetic path; and a housing of electrically insulative material radially outwardly of said shield.

2. The apparatus of claim 1 wherein said housing substantially surrounds said shield.

3. The apparatus of claim 2 wherein said housing has a longitudinal extent greater than that of said shield.

4. The apparatus of claim 1 wherein said housing is configured in size and shape to inhibit electrical arcing between said shield and ground.

5. The apparatus of claim 1 further comprising a case of electrical insulating material intermediate said windings and said shield.

6. The apparatus of claim 5 wherein said case comprises a groove configured to receive said shield.

7. An ignition apparatus comprising:

a core having a main axis;

a primary and secondary winding radially outwardly of said core, a first end of said primary winding being configured to be coupled to a power source and a second end of said primary winding being configured to be selectively coupled to ground;

a conductive shield radially outwardly of said windings that is floating relative to ground;

a housing of electrically insulative material radially outwardly of said shield;

a case of electrical insulating material intermediate said windings and said shield;

wherein said case comprises a groove configured to receive said shield; and wherein said groove comprises first and second annular shoulders, said housing overlapping at least one of said shoulders.

8. The apparatus of claim 7 wherein said housing overlaps said first and second shoulders.

9. An ignition apparatus comprising:

a core having a main axis;

a primary and secondary winding radially outwardly of said core, a first end of said primary winding being configured to be coupled to a power source and a second end of said primary winding being configured to be selectively coupled to ground;

a conductive shield radially outwardly of said windings that is floating relative to ground;

a housing of electrically insulative material radially outwardly of said shield, a case of electrical insulating material intermediate said windings and said shield; and a boot overlapping an axial end of said case.

10. An ignition apparatus for an internal combustion engine comprising:

a cylindrical central core having a main axis formed of magnetically-permeable material;

a primary and secondary winding radially outwardly of said central core, a first end of said primary winding being configured to be coupled to a positive bus of a power supply and a second end of said primary winding being configured for selective connection to ground;

a case of electrical insulating material radially outwardly of said windings;

an annular magnetically-permeable shield defining a side core radially outwardly of said case wherein said shield is floating relative to said positive bus and said ground and is configured to provide a magnetic path; and a housing of electrical insulating material radially outwardly of said shield.

11. An ignition apparatus for an internal combustion engine comprising:

a core having a main axis formed of magnetically-permeable material;

a primary and secondary winding radially outwardly of said core, a first end of said primary winding being configured to be coupled to a positive bus of a power supply and a second end of said primary winding being configured for selective connection to ground;

a case of electrical insulating material radially outwardly of said windings;

a magnetically-permeable shield radially outwardly of said case wherein said shield is floating relative to said positive bus and said ground; and a housing of electrical insulating material radially outwardly of said shield, wherein said case comprises a groove have first and second shoulders, and configured to receive said shield.

12. The apparatus of claim 11 wherein said housing overlaps at least one of said first and second shoulders.

13. The apparatus of claim 12 wherein said housing overlaps said first and second shoulders.

14. The apparatus of claim 13 further comprising a boot of electrical insulating material overlapping said case.

15. The apparatus of claim 14 wherein said boot overlaps an axial end of said case.

16. A method of operating an ignition apparatus having charge and discharge intervals comprising the step of electrically floating an annular magnetically-permeable shield portion of the apparatus defining a side core and which is configured to provide a magnetic path.

17. The method of claim 16 further comprising the step of connecting an end of a primary winding to ground to generate a primary current.

18. The method of claim 17 further comprising the step of interrupting the primary current to thereby generate a spark voltage on an end of a secondary winding.

* * * * *